US009376775B2

(12) United States Patent
Meier

(10) Patent No.: US 9,376,775 B2
(45) Date of Patent: Jun. 28, 2016

(54) CHANGE HOLDER ASSEMBLY FOR A COMPACTOR ROLLER FOR A SOIL COMPACTOR

(71) Applicant: HAMM AG, Tirschenreuth (DE)
(72) Inventor: Matthias Meier, Tirschenreuth (DE)
(73) Assignee: HAMM AG, Tirschenreuth (DE)

( * ) Notice: Subject to any disclaimer, the term of this patent is extended or adjusted under 35 U.S.C. 154(b) by 3 days.

(21) Appl. No.: 14/469,987
(22) Filed: Aug. 27, 2014
(65) Prior Publication Data
US 2015/0063908 A1 Mar. 5, 2015
(30) Foreign Application Priority Data
Aug. 27, 2013 (DE) ..... 10 2013 217 043
(51) Int. Cl.
*E01C 19/00* (2006.01)
*E01C 19/23* (2006.01)
*E02D 3/039* (2006.01)
(52) U.S. Cl.
CPC ..... *E01C 19/236* (2013.01); *E02D 3/039* (2013.01)
(58) Field of Classification Search
CPC ..... E01C 19/236; E02D 3/039
USPC ..... 404/121, 124; 172/540
See application file for complete search history.

(56) References Cited

U.S. PATENT DOCUMENTS 840,788 A * 1/1907 Meade ..... A01B 33/021 172/547
1,536,178 A * 5/1925 Hackett ..... B23D 61/06 299/108
2,131,947 A * 10/1938 Gilmore ..... E02D 3/026 172/554
2,242,808 A * 5/1941 Austin ..... E02D 3/026 172/554
2,312,471 A 3/1943 Low
2,893,298 A * 7/1959 Averette ..... B21D 37/04 292/355
3,099,191 A * 7/1963 Averette ..... E02D 3/026 172/556
3,126,654 A * 3/1964 Eyolfson et al. ..... E02F 9/2841 172/713
3,252,391 A * 5/1966 Dils, Jr. ..... E02D 3/026 301/44.1
3,274,908 A * 9/1966 Grant ..... E02D 3/026 404/121
3,822,957 A * 7/1974 Caron ..... E02D 3/026 172/554

(Continued)

FOREIGN PATENT DOCUMENTS

GB 2029761 * 8/1978 ..... B28D 1/22
WO 2013/107545 A2 7/2013

OTHER PUBLICATIONS

Search Report issued for European Patent Application No. 14182122.3 dated Nov. 21, 2014, with machine translation, 9 pages.

*Primary Examiner* — Raymond W Addie
(74) *Attorney, Agent, or Firm* — Rothwell, Figg, Ernst & Manbeck, P.C.

(57) ABSTRACT

A change holder assembly for a compactor roller for a soil compactor comprising a change holder to be fixed to a roller casing and at least one roller tool to be fixed to the change holder using a counterholder which can be caused to engage the change holder and is lockable with respect to the change holder, wherein the change holder has a roller-tool-abutment side and the at least one roller tool has a change holder-abutment side supportable on the roller-tool-abutment side, characterized in that on at least one side of roller-tool-abutment side and change holder-abutment side at least one anti-rotation lug, and on the other side of roller-tool-abutment side and change holder-abutment side at last one anti-rotation recess for receiving an anti-rotation lug are provided.

20 Claims, 3 Drawing Sheets

(56) References Cited

U.S. PATENT DOCUMENTS 4,066,375 A * 1/1978 Caron ..... E02D 3/026 172/554
4,668,122 A * 5/1987 Riddle ..... E02D 3/026 172/122
2012/0003041 A1 * 1/2012 McPhail ..... B60B 15/02 404/121
2012/0213586 A1 * 8/2012 Ugru ..... E02D 3/039 404/121
2014/0369752 A1 12/2014 Meier

* cited by examiner 58
40
42
22
VI 22
60
86
78
60
80
88
60
42
40
60

58
60
64
VII
22
60
62
76
78
80
74
62
40
60
64
VII
60

58
22
42
40

IV
IV
22
42
40

CHANGE HOLDER ASSEMBLY FOR A COMPACTOR ROLLER FOR A SOIL COMPACTOR

CROSS REFERENCE TO RELATED APPLICATIONS

This application is being filed under 35 U.S.C. §111 and claims priority to German Application No. DE 10 2013 217 043.2 filed on Aug. 27, 2013, the disclosure of which is incorporated herein in its entirety.

BACKGROUND OF THE INVENTION

1. Field of the Invention

The present invention relates to a change holder assembly for a compactor roller for a soil compactor, comprising a change holder to be fixed on a roller casing and at least one roller tool to be fixed on the change holder using a counterholder which can be brought into holding engagement with the change holder and is lockable with respect to the change holder, wherein the change holder has a roller-tool-abutment side and the at least one roller tool has a change holder-abutment side supportable on the roller-tool-abutment side.

2. Description of the Related Art

Such a change holder assembly is known from WO 2013/107545 A2. A plurality of change holders of trapezoidal design when viewed axially—with respect to the rotational axis of the compactor roller—are fixed on the outer circumference of a compactor roller or the roller casing of same. The change holders are elongated in the circumferential direction and have two circumferential sides oriented in the circumferential direction and two axial sides oriented in the direction of the rotational axis of the compactor roller. The two circumferential sides as well as the two axial sides are inclined with respect to each other such that the change holder is tapered proceeding from a connecting region attached to the compactor roller towards a roller-tool-abutment side provided for supporting a roller tool.

In the central region of this change holder, a holder opening is formed into which a holder shaft provided on the roller tool may be inserted. For locking of the roller tool on the change holder, an annular locking member is provided that surrounds the holder shaft and that can be positioned so as to engage a groove-like locking-member-receiver opening on the change holder on the one hand, and a groove-like locking-member-receiver opening on the holder shaft on the other hand.

In particular when a roller tool to be connected to such a change holder is not rotationally symmetrical, but rather has a shape which requires a defined rotational position about an opening longitudinal axis of the holder opening, in order to ensure that a roller tool assumes a defined position with respect to the change holder, the change holder is formed on its roller-tool-abutment side provided for supporting the roller tool such that with a complementary shape on a change holder abutment side of a specific roller tool provided for support on the change holder on the other side, it provides a form fit connection that substantially prevents rotation of a roller tool about the longitudinal opening axis.

SUMMARY OF THE INVENTION

It is the object of the present invention to further develop such a change holder assembly so as to provide increased security against twisting of a roller tool held in the change holder.

This object is inventively achieved by a change holder assembly for a compactor roller for a soil compactor, comprising a change holder to be fixed to a roller casing and at least one roller tool to be fixed to the change holder using a counterholder which can be brought into holding engagement with the change holder and is lockable with respect to the change holder, wherein the change holder has a roller-tool-abutment side and the at least one roller tool has a change holder-abutment side supportable on the roller-tool-abutment side.

Here it is further provided that on at least one side of the roller-tool-abutment side and change holder-abutment side, at least one anti-rotation lug is provided, and on the other side of the roller-tool-abutment side and change holder-abutment side at least one anti-rotation recess is provided for receiving an anti-rotation lug.

In the inventive design, in addition to the above-described complementary change holder design, which thus already produces a form-fit connection on the one hand, and a roller tool to be fixed thereon on the other hand, by provision of at least one anti-rotation recess and at least one anti-rotation lug to be positioned so as to engage said recess, a possible additional technical means is provided, which as regards its shape and for example also its engagement depth, can be formed so that that a roller tool on the change holder is optimally secured against twisting. In particular, an anti-rotation recess and an anti-rotation lug engaging therewith can be adapted to each other such that even when there is rotational loading of a roller tool, basically no loading forces on said roller tool are generated in the direction away from the change holder. Thus even if rotational loading of a rolling tool should arise, undesired detachment of same from the change holder is prevented.

In order on the one hand to ensure a stable connection of the change holder to a roller tool to be fixed thereto, and on the other hand to be able to use the available installation space efficiently for providing the anti-rotation functionality, it is proposed that the change holder or the counterholder comprise a holder opening and that the counterholder or change holder comprise a holder shaft, which may be inserted into the holder opening, wherein in at least one region at the side of the holder opening an anti-rotation recess or/and an anti-rotation lug is provided, and in at least one region at the side of the holder opening an anti-rotation lug or/and an anti-rotation recess is provided.

A very stable assembly that efficiently prevents undesired rotation of a roller tool can be provided in that in a first region at the side of the holder opening an anti-rotation recess or/and an anti-rotation lug is provided, and in a second region, opposite the first region, at the side of the holder opening an anti-rotation recess or/and an anti-rotation lug is provided, and in that in a first region at the side of the holder shaft an anti-rotation lug or/and an anti-rotation recess is provided, and in a second region, opposite the first region, at the side of the holder shaft an anti-rotation lug or/and an anti-rotation recess is provided.

In a design particularly advantageous for a compacting operation or a crushing operation, it is proposed that the change holder have a connecting region preferably adapted to the curved outer circumference of the compactor roller for connecting to an outer circumferential surface of the compactor roller, as well as the roller-tool-abutment side formed for supporting a roller tool and disposed at a distance from the outer circumferential surface of the compactor roller, wherein preferably the change holder has two circumferential sides to be oriented substantially in the circumferential direction of a compactor roller as well as two axial sides to be oriented substantially in the direction of a compactor roller rotational axis, wherein also preferably the change holder is tapered from the connecting region to the roller-tool-abutment side and the circumferential sides are inclined toward one other by a larger angle than the axial sides.

It can further be provided that at least one anti-rotation recess or/and at least one anti-rotation lug is provided in the region of at least one axial side of the change holder. Also in this design a symmetrical arrangement is advantageously provided wherein an anti-rotation lug or an anti-rotation recess can be provided on both axial sides.

In order to be able to perform an efficient compacting or crushing operation using the inventive change holder assembly, it is proposed that between the connecting region and the roller-tool abutment side, the change holder have a soil working region on this attached roller tool that comes in contact with the soil to be worked, wherein preferably on at least one circumferential side in the soil working region at least one soil working protuberance is provided.

An assembly in which, on the one hand, the elements can be provided for stable connection of a roller tool on the change holder, and on the other hand the inventively proposed technical means for preventing rotation of the roller tool can be provided, is suggested such that the holder opening is provided in the change holder and that on the roller-tool-abutment side the holder opening is surrounded by a first supporting surface which is preferably substantially orthogonal with respect to an opening longitudinal axis, wherein at least one anti-rotation recess or/and at least one anti-rotation lug is provided in the first supporting surface or/and adjacent to the first supporting surface.

In addition to the inventively provided measures which keep the roller tool from rotating on the change holder, it is proposed that a form-fit connection element for producing a form-fit connection with a counter form-fit connection element on the change holder-abutment side of the at least one roller tool is provided on the roller-tool-abutment side. Using elements which interact with each other in this manner, not only is the anti-rotation functionality supported, but a uniform distribution of the load transmitted from a roller tool to a change holder is also ensured.

For this purpose it can be provided, for example, that the holder opening is provided in the change holder and that a plurality of second support surfaces angled away from each other is provided on the roller-tool-abutment surface around the holder opening, wherein every second supporting surface is provided in the adjacent region of a circumferential side on an axial side or/and that on the roller tool abutment side on at least one axial side between two second supporting surfaces at least one third supporting surface angled with respect to these second supporting surfaces is provided, or/and that on the roller-tool-abutment side on at least one circumferential side between two second support surfaces at least one fourth supporting surface angled with respect to the latter is provided.

In particular when the second supporting surfaces or/and the third supporting surfaces or/and the fourth supporting surfaces are angled with respect to the first supporting surface and preferably surround it in an annular manner, a prism-like formation is obtained which ensures an engagement which is stable and generates uniform loading between a roller tool and a change holder.

For interacting with the various supporting surfaces, it is further proposed that at least one roller tool have at least one second countersupporting region for support on a second supporting surface or/and at least one third countersupporting region for support on a third supporting surface or/and at least one fourth countersupporting region for support on at least one fourth supporting surface.

A stable connection of a roller tool on the change holder can be achieved in that the counterholder is lockable on the change holder using a locking member.

In particular it can be provided hereby that on an inner circumference of the holder opening a first locking-member-receiving opening is provided, preferably in an annular groove design or/and that on an outer circumference of the holder shaft a second locking-member-receiving opening is formed, preferably in an annular groove design, wherein in the first locking-member-receiving opening or the second locking-member-receiving opening a preferably annular locking member is received, which locking member may be clicked into the respective other locking-member-receiving opening for locking a roller tool on the change holder. This design, which ensures cohesion of the change holder with a roller tool, basically does not prevent rotation of a roller tool. This task is assumed in the inventive design primarily by the mutually engaging anti-rotation lugs and anti-rotation recesses.

A roller tool to be fixed on such a change holder can comprise a chisel, but can in principle also comprise a pad foot. Here it should be noted that both chisels and tamping feet can be provided with different configurations. In particular, in the design of a roller tool as a pad foot having a generally non-rotationally-symmetric design, provision of the inventive anti-rotation lugs or anti-rotation recesses for ensuring defined positioning of a roller tool on the change holder is of substantial importance.

The present invention further relates to a compactor roller for a soil compactor, which compactor roller comprises at least one inventive change holder assembly on an outer circumference thereof. Here it should be noted that in general a plurality of such change holder assemblies is provided, each in annular formations on the outer circumference of the compactor roller so as to generate a uniform compacting- or crushing functionality over the entire roller circumference and over the entire roller length.

The invention further relates to a soil compactor that has at least one such compactor roller.

BRIEF DESCRIPTION OF THE DRAWINGS

The present invention is described below with reference to the accompanying figures.

DETAILED DESCRIPTION OF THE INVENTION

Figure 1:
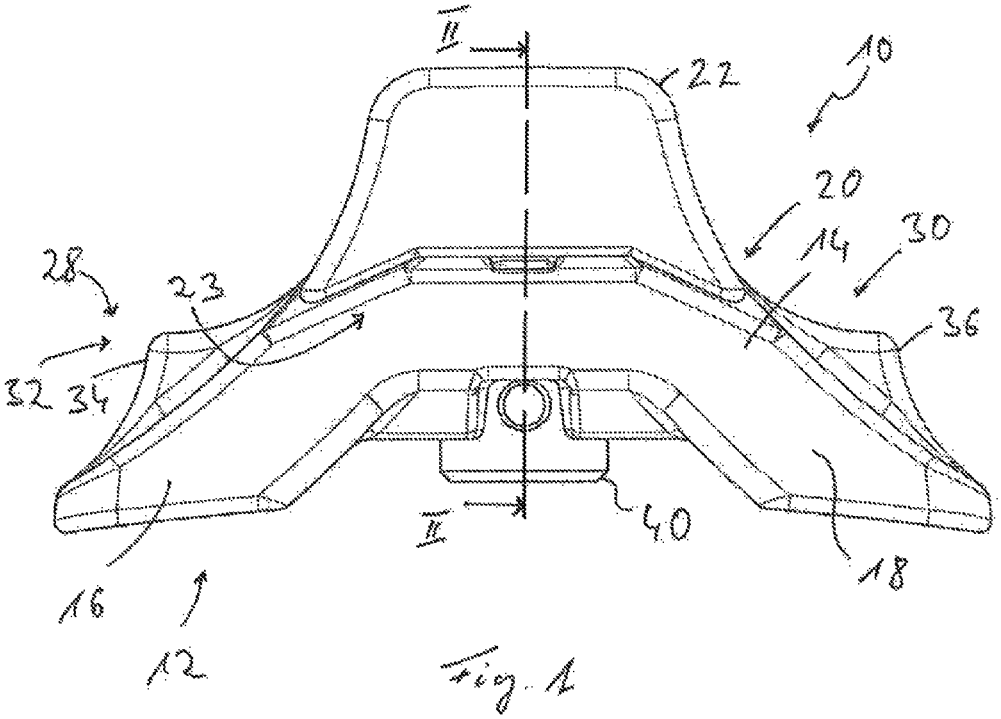
FIG. 1 shows a side view of a change holder assembly for a compactor roller for a soil compactor.
Figure 2:
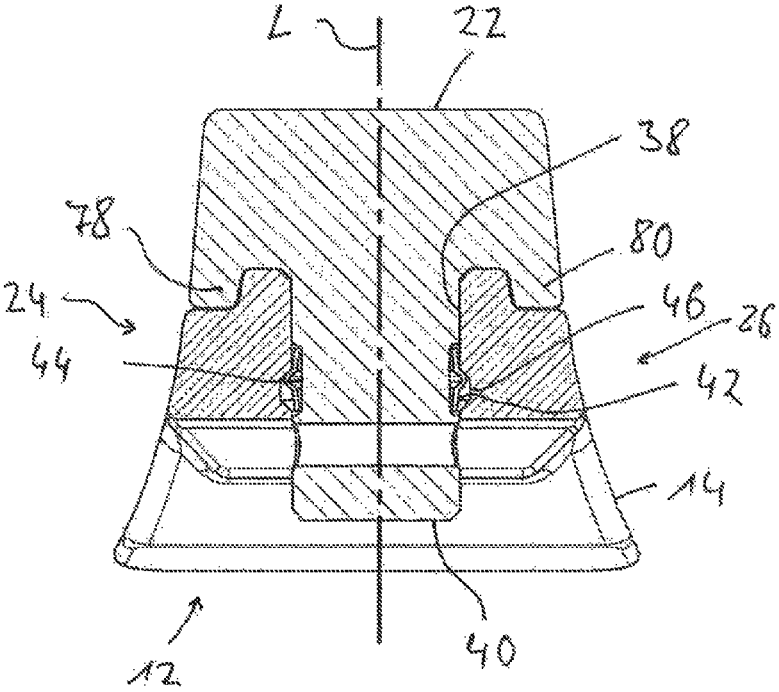
FIG. 2 shows a side view of the change holder of FIG. 1, cut along line II-II in FIG. 1.
Figures 3, 4, 5, 6, 7:
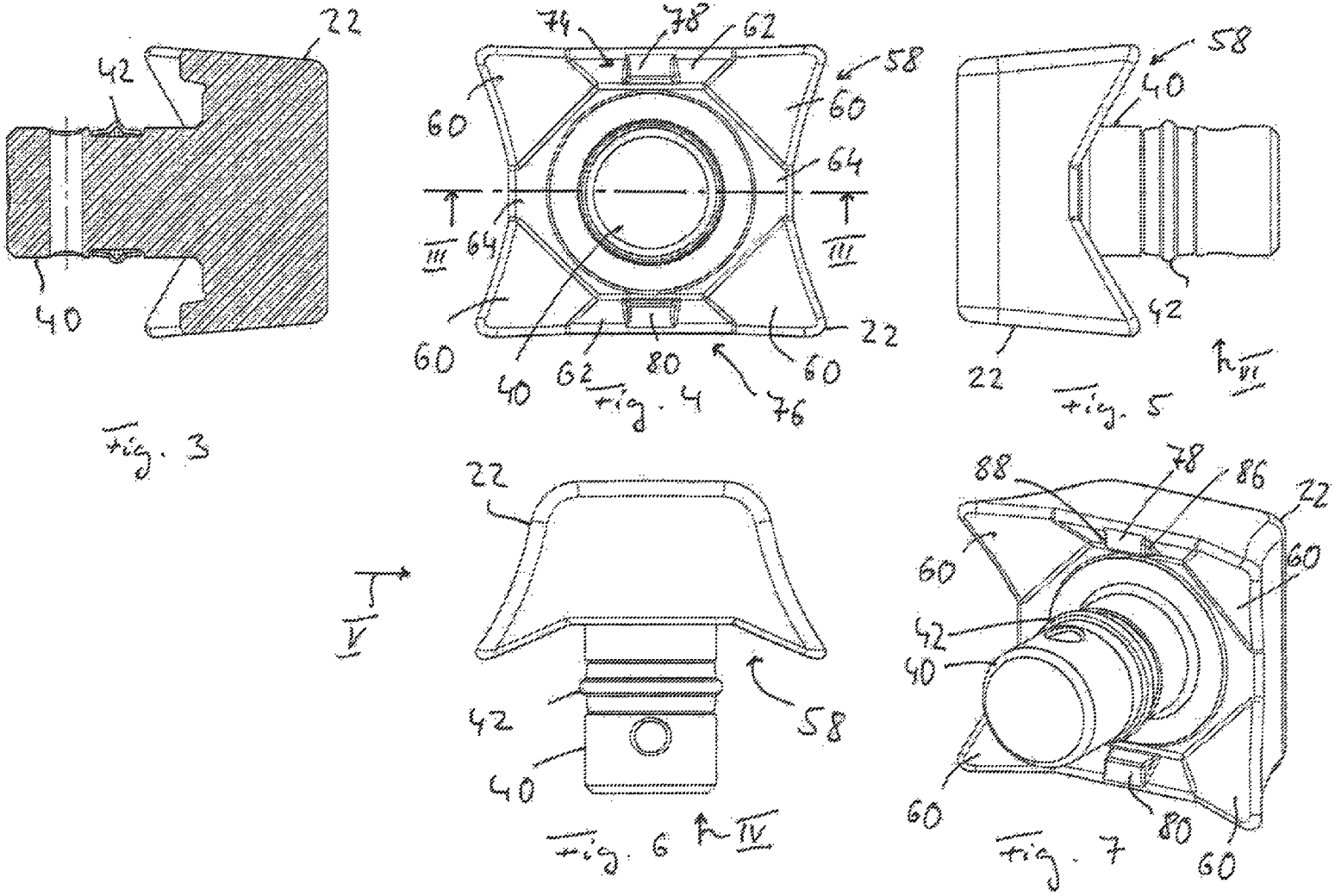
FIG. 3 shows a side view of a roller tool used in the change holder assembly of FIG. 1, cut along line III-III in FIG. 4.
FIG. 4 shows a view of the roller tool in viewing direction IV in FIG. 6.
FIG. 5 shows a side view of the roller tool in viewing direction V in FIG. 6.
FIG. 6 shows a side view of the roller tool in viewing direction VI in FIG. 5.
FIG. 7 shows a perspective view of the roller tool.

The change holder assembly 10 shown in FIGS. 1 and 2 comprises a change holder 14 to be fixed to a connecting region, generally designated by 12, on the outer circumference of a roller casing of a compactor roller of a soil compactor. This trapezoidal change holder 14 in the side view in FIG. 1 is generally U-shaped and is to be fixed on the roller casing, for example by welding, using its two arm regions 16, 18. On a roller-tool-abutment side 20 to be positioned at a distance from the roller casing, the change holder 14 is configured such that it can receive a roller tool 22 formed as pad foot in the exemplary embodiment of FIGS. 1 and 2, or can support said roller tool with its change holder-abutment side 23.

Figure 8:
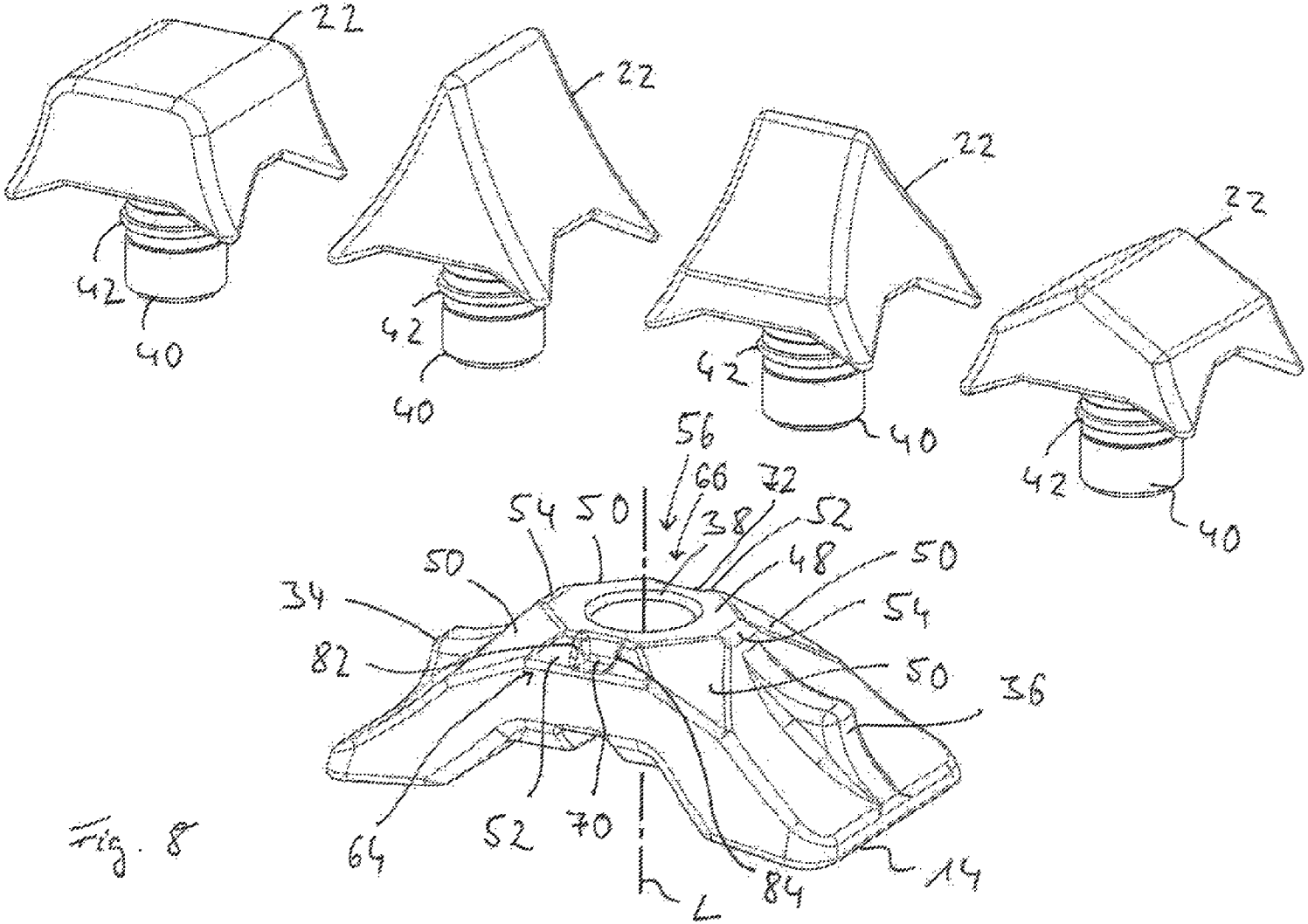
FIG. 8 shows a change holder of the change holder assembly of FIG. 1 including different roller tools to be mounted thereon.

The change holder, also shown in perspective view in FIG. 8, comprises two axial sides 24, 26 which when attached to the outer circumference of a roller casing preferably are oriented in the direction of a rotational axis of a compactor roller, and two circumferential sides 28, 30 which preferably are oriented in the circumferential direction about this compactor-roller rotational axis. Both the axial sides 24, 26 and the circumferential sides 28, 30 are angled with respect to each other, wherein the inclination angle of the circumferential sides with respect to each other is greater than the inclination angle of the axial sides 24, 26.

On the two axial arm regions 16, 18 in a soil-working region 32 not covered by the roller tool 22, a blade-like projecting soil-working protuberance 34, 36 is provided. In compacting or crushing operations these soft-working protuberances 34, 36 come into contact with the subsurface to be worked and can crush rocks or gravel.

In the central region of the change holder 14, a holder opening 38 is formed that extends along an opening longitudinal axis L. A holder shaft 40 insertable into this holder opening 38 is provided on the roller tool 22. Both the holder opening 38 and the holder shaft 40 are formed with a circular cross-section, for example.

For locking the roller tool 22 to the change holder 14, for example an annular locking member 42 surrounding the holder shaft 40 is received in a locking-member-receiving opening 44 formed on the outer circumferential surface thereof. A likewise annular locking-member-receiving opening 46, into which the annular locking member 42 can be clicked, is provided in the holder opening 38. To disconnect the roller tool 22 from the change holder 14, a tool designed as a crowbar or the like can engage the change holder 14 and act on the free end of the holder shaft 40 in order to release the locking engagement of the locking member 42 in the locking-member-receiving opening 46.

On the roller-tool-abutment side 20 visible in FIG. 8, a first supporting area 48, oriented for example substantially orthogonally with respect to the opening longitudinal axis L, is provided and surrounds the holder opening 38 in the tool holder 14. On the adjacent regions between a specific circumferential side 28, 30 on the axial sides 24, 26, second supporting surfaces 50 are provided, which are adjacent to the first supporting surface 48 and radially outward from the opening longitudinal axis L. A third supporting surface 52 is between two respective supporting surfaces 50 in association with the same axial side 24 or 26. Accordingly, a fourth supporting surfaces 54 are provided between two second supporting surfaces 50 respectively associated with the same circumferential side 28 or 30.

The second supporting surfaces 50, third supporting surfaces 52, and fourth supporting surfaces 54 form a facet-like or prismatic surface formation annularly surrounding the first supporting surface 48, generally providing a form-fit connection element 56. For support interaction, the roller tool 22 depicted in detail in FIGS. 3 to 7 thus has a counter-form-fit connection element, generally designated by 58, on its change holder-abutment side 23. This comprises, in the four edge regions of the roller tool 22, second countersupporting regions 60 which can abut the second supporting surfaces 50. A third countersupporting region 62 lies between each two such countersupporting regions 60, and can enter into supporting interaction with a third supporting surface 52. Accordingly, fourth countersupporting regions 64 lie between two adjacent second countersupporting regions 60 and can enter into supporting interaction with a fourth supporting surface 54. Due to the complementary shape of the form-fit connection element 56 with the counter-form-fit connection element 58, a uniform bad distribution of bad from the roller tool 22 to the change holder 14 in compacting- or crushing operations is achieved. Simultaneously, to a certain extent the roller tool 22 is secured against twisting, since twisting of same with respect to the change holder 14 would be possible only if the locking engagement of the locking member 42 in the locking-member-receiving opening 46 of the change holder 14 were eliminated, and the holder shaft 40 were at least partially pulled out from the holder opening 38.

It should be noted here that of course the form-fit connection element 56 and the counter-form-fit connection element 58 can be configured such that all above-mentioned supporting surfaces and countersupporting regions can abut one another. In principle however, it could also be provided for example that an abutment interaction is effected only in the four edge regions, that is, in the second supporting surfaces 50 or second countersupporting regions 60.

In order to ensure further increased rotational locking of the roller tool 22 with respect to the change holder 14 independently of the above-described interaction of the form-fit-connection element 56 with the counter-form-fit connection element 58, or in addition thereto, anti-rotation recesses 70, 72 are provided in regions 66, 68 situated laterally with respect to the holder opening 38. Said anti-rotation recesses 70, 70 connect radially outward to the first supporting surfaces 48 or can extend into the region of same and lie diametrically opposite each other with respect to the holder opening 38 or the opening longitudinal axis L. It is evident that the two anti-rotation recesses 70, 72 are formed substantially in the region of the third supporting surfaces 52 and are open both in the direction of the opening longitudinal axis L away from the connecting region 12 and in the direction of the axial sides 24, 26.

In association with these two anti-rotation recesses 70, 72, anti-rotation lugs 78, 80 are provided on the roller tool 22 in regions 74, 76 situated laterally with respect to the holder shaft 40. These lie substantially diametrically opposite each other with respect to the holder shaft 40 and are dimensioned and positioned such that they engage the anti-rotation recesses 70, 72 when the roller tool 22 is attached to the change holder 14. Stable rotational locking is thus provided for the roller tool 22 with respect to the change holder 14. For this purpose it can be provided in particular that in the rotational direction, i.e. substantially in the circumferential direction with respect to the opening longitudinal axis L or a corresponding longitudinal axis of the holder shaft 40, the anti-rotation recesses 70 are bounded by side surfaces 82, 84 oriented substantially parallel to the opening longitudinal axis L, and that accordingly the anti-rotation lugs 78, 70 are bounded in the direction of the opening longitudinal axis L or in the direction of the longitudinal axis of the holder shaft 40 by substantially parallel side surfaces 86, 88. A rotational load of a roller tool 42 thus leads to mutual abutment of the side surfaces 88 with the side surfaces 84, for example, which due to their substantially parallel orientation with respect to the opening longitudinal axis L generate virtually no force component acting in the direction of the opening longitudinal axis L. A rotational load of the roller tool 22 thus does not lead to a forced axial load, which could lead to detachment of the locking member 42 from the change holder 14.

Let it be noted that the above-described anti-rotation recesses 70, 72 or anti-rotation lugs 78, 80 could naturally be provided in a different shape, a different quantity, or different positioning, for example in the circumferential direction about the opening longitudinal axis L. Of course it is also possible to provide the anti-rotation recesses on the roller tool 22 and the anti-rotation lugs on the change holder 14. In addition, in order to make possible only a more limited number of installation positions of a roller tool 22 on the change holder 14, for example, one anti-rotation lug and one anti-rotation recess could be provided on the roller tool 22, while one anti-rotation recess and one anti-rotation lug could be provided on the change holder 14 as a complement thereto.

It should be further noted that, as shown in FIG. 8, the inventive provision of mutually engaging anti-rotation lugs and anti-rotation recesses is in particular of special significance if a roller tool is configured in a non-rotationally-symmetrical, and thus with a shape requiring some relative positioning with respect to the change holder 14. This relates in particular to the different designs of tamping feet depicted in FIG. 8, which can be designed, for example, with a blunt or sloping configuration or with a wedge-like configuration oriented in a different direction. Nonetheless, a roller tool having a substantially rotationally-symmetrical design as shown in the figures, such as a chisel or round shank bit, can be attached. This can be inserted in the holder opening 38 with a chisel shaft as holder shaft and be supported with its chisel head on the roller-tool-abutment side 20 on the first supporting surface 48 surrounding the holder opening 38.

I claim:

1. A change holder assembly for a compactor roller for a soil compactor, comprising:

a change holder to be fixed on a roller casing; and at least one roller tool to be fixed on the change holder using a counterholder, which can be caused to engage with the change holder and is lockable with respect to the change holder;

wherein the change holder has a roller-tool-abutment side and the at least one roller tool has a change holder-abutment side supportable on the roller-tool abutment side;

wherein on at least one side of roller-tool-abutment side and change holder-abutment side at least one anti-rotation lug and on the other side of roller-tool-abutment side and change holder-abutment side at least one anti-rotation recess for receiving an anti-rotation lug are provided;

wherein the change holder or the counterholder comprises a holder opening and that the counterholder or the change holder comprises a holder shaft which is insertable into the holder opening;

wherein at least one region at the side of the holder opening at least one of an anti-rotation recess and an anti-rotation lug is provided and in at least one region at the side of the holder shaft at least one of an anti-rotation lug and an anti-rotation recess is provided;

wherein in a first region at the side of the holder opening at least one of an anti-rotation recess and an anti-rotation lug is provided, and in a second region opposite the first region at the side of the holder opening at least one of an anti-rotation recess and an anti-rotation lug is provided, and that in a first region at the side of the holder shaft at least one of an anti-rotation lug and an anti-rotation recess is provided and in a second region opposite the first region at the side of the holder shaft at least one of an anti-rotation lug and an anti-rotation recess is provided.

2. The change holder assembly according to claim 1, wherein at least one of an anti-rotation recess and an anti-rotation lug is bounded by side surfaces which are substantially parallel or positionable parallel to an opening longitudinal axis of the holder opening.

3. The change holder assembly according to claim 1, wherein the change holder has a connecting region adapted to the curved outer circumference of the compactor roller, formed for connecting to an outer circumferential surface of the compactor roller and a roller-tool-abutment side formed for supporting a roller tool and to be disposed at a distance from the outer circumferential surface of the compactor roller.

4. The change holder assembly according to claim 3, wherein at least one of an anti-rotation recess and an anti-rotation lug is provided in the region of at least one axial side of the change holder.

5. The change holder assembly according to claim 3, wherein between the connecting region and the roller-tool-abutment side the tool holder has a soil working region coming in contact with the soil to be worked when a roller tool is attached thereon.

6. The change holder assembly according to claim 1, wherein the holder opening is provided in the change holder and that on the roller-tool-abutment side the holder opening is surrounded by a first supporting surface which is substantially orthogonal with respect to an opening longitudinal axis (L), wherein in at least one of the first supporting surface or/and adjacent to the first supporting surface at least one of an anti-rotation recess and an anti-rotation lug is provided.

7. The change holder assembly according to claim 1, wherein on the roller-tool-abutment side a form-fit connection element is provided for producing a form-fit engagement with a counter-form-fit connection element on the change holder-abutment side of the at least one roller tool.

8. The change holder assembly according to claim 1, wherein the holder opening is provided in the change holder and that a plurality of mutually angled second supporting surfaces is provided on the roller-tool-abutment side around the holder opening, wherein every second supporting surface is provided in a region where a circumferential side is adjacent to an axial side.

9. The change holder assembly according to claim 8, wherein on the roller-tool-abutment side on at least one axial side between two second supporting surfaces at least one third supporting surface, angled with respect to at least one of said second supporting surfaces is provided and that on the roller-tool-abutment side on at least one circumferential side between two second supporting surfaces at least one fourth supporting surface angled with respect to said second supporting surfaces is provided.

10. The change holder assembly according to claim 8, wherein at least one of the second supporting surfaces, the third supporting surfaces, and the fourth supporting surfaces are angled with respect to the first supporting surface.

11. The change holder assembly according to claim 8, wherein at least one roller tool has at least one of a second countersupporting region for supporting on a second supporting surface, a third countersupporting region for supporting on a third supporting surface, and a fourth countersupporting region for supporting on at least one fourth supporting surface.

12. The change holder assembly according to claim 1, wherein the counterholder is lockable on the change holder using a locking member.

13. The change holder assembly according to claim 12, wherein on an inner circumference of the holder opening at least one of an annular first locking-member-receiving opening is provided and that on an outer circumference of the holder shaft an annular-groove-shaped second locking-member-receiving opening is formed, wherein in the first locking-member-receiving opening or the second locking-member-receiving opening a lockable, annular locking member is received for locking a roller tool to the change holder in the other locking-member-receiving opening.

14. The change holder assembly according to claim 1, wherein at least one roller tool comprises at least one of a chisel and a pad foot.

15. A compactor roller for a soil compactor, comprising on an outer circumference at least one change holder assembly according to claim 1.

16. A soil compactor comprising at least one compactor roller according to claim 15.

17. The change holder assembly according to claim 3, wherein the change holder has two circumferential sides to be oriented substantially in the circumferential direction of a compactor roller, and two axial sides to be oriented substantially in the direction of a compactor roller rotational axis.

18. The change holder assembly according to claim 3, wherein the change holder is further tapered from the connecting region to the roller-tool-abutment side and the circumferential sides are inclined at a greater angle to each other than the axial sides.

19. The change holder assembly according to claim 5, wherein on at least one circumferential side in the soil working region at least one soil working protuberance is provided.

20. The change holder assembly according to claim 10, wherein at least one of the second supporting surfaces, the third supporting surfaces, and the fourth supporting surfaces surround the first supporting surface in an annular fashion.

* * * * *